US009388702B2

(12) United States Patent
Oikawa et al.

(10) Patent No.: US 9,388,702 B2
(45) **Date of Patent: *Jul. 12, 2016**

(54) PRECIPITATION HARDENING MARTENSITIC STAINLESS STEEL, AND STEAM TURBINE LONG BLADE, STEAM TURBINE, AND POWER PLANT USING THE SAME

(71) Applicant: Hitachi, Ltd., Tokyo (JP)

(72) Inventors: Shinji Oikawa, Hitachi (JP); Hideo Yoda, Hitachi (JP); Masahiko Arai, Hitachinaka (JP); Hiroyuki Doi, Tokai (JP)

(73) Assignee: MITSUBISHI HITACHI POWER SYSTEMS, LTD., Kanagawa (JP)

( * ) Notice: Subject to any disclaimer, the term of this patent is extended or adjusted under 35 U.S.C. 154(b) by 597 days.

This patent is subject to a terminal disclaimer.

(21) Appl. No.: 13/741,946

(22) Filed: Jan. 15, 2013

(65) Prior Publication Data

US 2013/0186106 A1 Jul. 25, 2013

(30) Foreign Application Priority Data

Jan. 19, 2012 (JP) ..... 2012-008564

(51) Int. Cl.

| | |
|---|---|
| ***C22C 38/44*** | (2006.01) |
| ***C22C 38/50*** | (2006.01) |
| ***F01D 5/28*** | (2006.01) |
| ***C22C 38/00*** | (2006.01) |
| ***C22C 38/04*** | (2006.01) |
| ***C22C 38/06*** | (2006.01) |
| ***C22C 38/52*** | (2006.01) |

(Continued)

(52) U.S. Cl.

CPC .. *F01D 5/28* (2013.01); *C21D 6/02* (2013.01); *C21D 7/13* (2013.01); *C21D 9/0068* (2013.01); *C22C 38/001* (2013.01); *C22C 38/04* (2013.01); *C22C 38/06* (2013.01); *C22C 38/44* (2013.01); *C22C 38/50* (2013.01); *C22C 38/52* (2013.01); *C21D 6/004* (2013.01); *C21D 2211/008* (2013.01); *F05D 2230/72* (2013.01); *F05D 2300/171* (2013.01)

(58) Field of Classification Search

None

See application file for complete search history.

(56) References Cited

U.S. PATENT DOCUMENTS

| | | | |
|---|---|---|---|
| 3,342,590 | A | 9/1967 | Bieber |
| 4,842,663 | A | 6/1989 | Kramer |

(Continued)

FOREIGN PATENT DOCUMENTS

| | | | |
|---|---|---|---|
| EP | 0237170 | B1 | 5/1994 |
| GB | 2 423 090 | A | 8/2006 |

(Continued)

*Primary Examiner* — Deborah Yee

(74) *Attorney, Agent, or Firm* — Volpe and Koenig, P.C.

(57) ABSTRACT

The problem to be solved of the present invention is to provide a precipitation hardening martensitic stainless steel having excellent tissue stability, strength, toughness, and corrosion-resistance, requiring no sub-zero treatment, and having excellent productivity; and also a steam turbine long blade using the same. The problem is solved by providing a precipitation hardening martensitic stainless steel containing, by mass, 0.1% or less of C; 0.1% or less of N; 9.0% or more and 14.0% or less of Cr; 9.0% or more and 14.0% or less of Ni; 0.5% or more and 2.5% or less of Mo; 0.5% or less of Si; 1.0% or less of Mn; 0.25% or more and 1.75% or less of Ti; 0.25% or more and 1.75% or less of Al, and the rest is Fe and inevitable impurities; and a steam turbine long blade using the precipitation hardening martensitic stainless steel.

11 Claims, 9 Drawing Sheets

Steam turbine long blade

(51) Int. Cl.

| | |
|---|---|
| ***C21D 6/02*** | (2006.01) |
| ***C21D 7/13*** | (2006.01) |
| ***C21D 9/00*** | (2006.01) |
| *C21D 6/00* | (2006.01) |

(56) References Cited

U.S. PATENT DOCUMENTS

| | | | | |
|---|---|---|---|---|
| 5,116,570 | A | | 5/1992 | Kim et al. |
| 9,062,362 | B2 | * | 6/2015 | Oikawa et al. |
| 2010/0139817 | A1 | | 6/2010 | Montagnon |

FOREIGN PATENT DOCUMENTS

| | | | | | |
|---|---|---|---|---|---|
| JP | 2001-098349 | A | | 4/2001 | |
| JP | 2005171339 | | * | 6/2005 | ..... C22C 38/00 |
| JP | 2005-194626 | A | | 7/2005 | |
| JP | 2008-546912 | A | | 12/2008 | |
| WO | 2007/003748 | A1 | | 1/2007 | |
| WO | 2012/002208 | A1 | | 1/2012 | |

* cited by examiner

Steam turbine long blade

PRECIPITATION HARDENING MARTENSITIC STAINLESS STEEL, AND STEAM TURBINE LONG BLADE, STEAM TURBINE, AND POWER PLANT USING THE SAME

CROSS-REFERENCE TO RELATED APPLICATION

The present application claims priority from Japanese Patent Application No. 2012-008564 filed on Jan. 19, 2012, the content of which is hereby incorporated by reference into this application.

TECHNICAL FIELD OF THE INVENTION

The present invention relates to a precipitation hardening martensitic stainless steel of which tissue has excellent tissue stability, strength, toughness, and corrosion-resistance, requiring no sub-zero treatment, and having excellent productivity. The present invention also relates to a steam turbine long blade, a steam turbine, and a power plant using the same.

BACKGROUND OF THE INVENTION

Recently, in terms of energy saving such as the conservation of fossil fuel and the prevention of global warming such as the suppression of $CO_2$ gas production, it has been demanded to improve the efficiency of a thermal power plant such as efficiency improvement in a steam turbine. One of the effective measures for improving the efficiency of a steam turbine is to increase the size of a steam turbine long blade. In addition, an increase in the size of a steam turbine long blade is also expected to have secondary effects such as shortening the facility construction period, and reducing the resulting cost by decreasing in the number of casings.

A long blade material having excellent mechanical properties and corrosion-resistance is required to improve the reliability of a steam turbine. A precipitation hardening martensitic stainless steel has a large amount of Cr and a small amount of C and thus has excellent corrosion-resistance. However, the balance between the strength and toughness thereof is poor (see, e.g. Japanese patent publication No: 2005-194626).

A material which contains increased amounts of precipitate forming elements to increase strength has a low martensite transformation finish-temperature (martensite transformation finish point), leading to problems with productivity. For example, a sub-zero treatment cooling with dry ice, is required to obtain an uniform martensite tissue (see, e.g., Japanese Patent Publication NO: 2008-546912).

SUMMARY OF THE INVENTION

An object of the invention is to provide a precipitation hardening martensitic stainless steel of which tissue has excellent stability, strength, toughness, and corrosion-resistance, requiring no sub-zero treatment, and having excellent productivity; and also a steam turbine long blade using the same.

The precipitation hardening martensitic stainless steel of the present invention contains, by mass, 0.1% or less of C; 0.1% or less of N; 9.0% or more and 14.0% or less of Cr; 9.0% or more and 14.0% or less of Ni; 0.5% or more and 2.5% or less of Mo; 0.5% or less of Si; 1.0% or less of Mn; 0.25% or more and 1.75% or less of Ti; 0.25% or more and 1.75% or less of Al, and the rest is Fe and inevitable impurities.

According to the present invention, it is possible to provide a precipitation hardening martensitic stainless steel of which tissue has excellent stability, strength, toughness, and corrosion-resistance, requiring no sub-zero treatment, and having excellent productivity; and also a steam turbine long blade using the same.

BRIEF DESCRIPTIONS OF THE DRAWINGS

FIG. 1 shows a perspective view schematically showing an example of a steam turbine long blade of the present invention;

FIG. 2 schematically shows an example of a low-pressure stage rotor of the present invention;

FIG. 3 schematically shows an example of a low-pressure stage turbine of the present invention;

FIG. 4 schematically shows an example of a power plant of the present invention;

DESCRIPTIONS OF THE PREFERRED EMBODIMENTS

Figure 1:
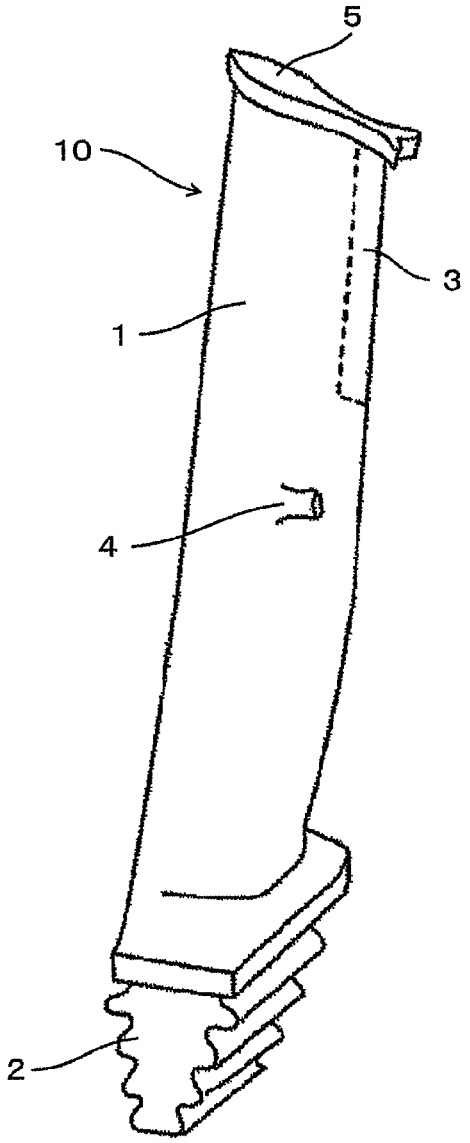

Hereinafter, the function and amount of constituent elements contained in a precipitation hardening martensitic stainless steel of the present invention will be described.

In the following description, the amount of constituent elements is expressed as percentage by mass.

Carbon (C) forms a Cr carbide, causing problems such as a decrease in toughness due to the excessive precipitation of the carbide, a decrease in corrosion-resistance due to a decrease in the Cr concentration near the grain boundary. Furthermore, C causes a significant decrease in the martensite transformation finish point. Therefore, the amount of C is required of suppressing to preferably 0.1% or less, and more preferably 0.05% or less.

Nitrogen (N) forms TiN and AlN to reduce fatigue strength, and also adversely affects toughness. Moreover, N causes a significant decrease in the martensite transformation finish point. Therefore, the amount of N is required of suppressing to preferably 0.1% or less, and more preferably 0.05% or less.

Chromium (Cr) is an element forming a passivation film on the surface and thus contributes for improving the corrosion-resistance. When the lower limit of addition is 9.0%, sufficient corrosion-resistance can be ensured. Meanwhile, the excessive addition of Cr causes the formation of δ-ferrite, which significantly deteriorates mechanical properties and corrosion-resistance. Therefore, the upper limit has been specified as 14.0%. From above, the amount of Cr added is required 9.0 to 14.0%. The amount is preferably 11.0 to 13.0%, and particularly preferably 11.5 to 12.5%.

Nickel (Ni) is an element suppressing the formation of δ-ferrite and also contributes for improving the strength by the precipitation hardening of Ni—Ti and Ni—Al compounds. Moreover, Ni also improves hardenability and toughness. The lower limit of addition is required 9.0% to achieve sufficient effects above. Meanwhile, when the amount added is more than 14.0%, since residual austenite precipitates, the desired tensile strength cannot be obtained. From the above points, the amount of Ni added is required 9.0 to 14.0%. The amount is more preferably 11.0 to 12.0%, and particularly preferably 11.25 to 11.75%.

Molybdenum (Mo) is an element improving the corrosion-resistance. The amount added is required at least 0.5% to obtain the desired corrosion-resistance. Meanwhile, when the amount added is more than 2.5%, the formation of δ-ferrite is promoted, and the characteristics are deteriorated instead. From the above points, the amount of Mo added is required 0.5 to 2.5%. The amount is more preferably 1.0 to 2.0%, and particularly preferably 1.25 to 1.75%.

Silicon (Si) is a deoxidizer and is preferably in an amount of 0.5% or less. This is because an amount of more than 0.5% causes the problem of the precipitation of δ-ferrite. The amount is more preferably 0.25% or less, and particularly preferably 0.1% or less. It is possible to omit the addition of Si by applying carbon vacuum deoxidation and electro-slag remelting. In that case, it is preferable not to add Si.

Manganese (Mn) is a deoxidizer and a desulfurizer and needed to add at least 0.1% or more to suppress the formation of δ-ferrite. Meanwhile, an amount of more than 1.0% causes a decrease in toughness. Therefore, the amount of Mn added is required 0.1 to 1.0%. The amount is more preferably 0.3 to 0.8%, and particularly preferably 0.4 to 0.7%.

Aluminum (Al) is an element forming a Ni—Al compound and contributes for precipitation hardening. It is necessary for precipitation hardening to be sufficiently developed that the amount added is at least 0.25% or more. The amount added is more than 1.75% causes the deterioration of mechanical properties due to the excessive precipitation of a Ni—Al compound or the formation of δ-ferrite. From the above points, the amount of Al added is required 0.25 to 1.75%. The amount is more preferably 0.5 to 1.5%, and particularly preferably 0.75 to 1.25%.

Titanium (Ti) forms a Ni—Ti compound and contributes to precipitation hardening. It is necessary that the lower limit of addition is 0.25% to sufficiently obtain the above effects. The excessive addition of Ti leads to the formation of δ-ferrite, and thus the upper limit has been specified as 1.75%. Therefore, the amount of Ti added is required 0.25 to 1.75%. The amount is more preferably 0.5 to 1.5%, and particularly preferably 0.75 to 1.25%.

The total amount of Al and Ti added needs 0.75% or more and 2.25% or less. If the amount is less than 0.75%, precipitation hardening is insufficient, the desired tensile strength cannot be obtained. Meanwhile, an amount of more than 2.25% leads to excessive precipitation hardening, and the resulting toughness is lower than desired.

Niobium (Nb) is an element contributing for improving the strength and corrosion-resistance by forming a carbide. When the amount is less than 0.05%, the effect is insufficient, while when the amount added is 0.5% or more, the formation of δ-ferrite is promoted. From the above points, the amount of Nb added needs 0.05 to 0.5%. The amount is more preferably 0.1 to 0.45%, and particularly preferably 0.2 to 0.3%.

Vanadium (V) and tantalum (Ta) may be replaced with Nb. When two or three kinds of Nb, V, and Ta are added in combination, the total amount added is required the same as the amount of Nb added alone. Though addition of these elements is not indispensable, this leads to more significant precipitation hardening.

Tungsten (W) is effective in improving the corrosion-resistance as well as Mo. Though addition of W is not indispensable, the addition in combination with Mo can further increase this effect. In this case, in order to prevent the precipitation of δ-ferrite, the total amount of Mo and W added is required the same as the amount of Mo added alone.

Cobalt (Co) is effective in suppressing the formation of δ-ferrite and improving the martensite tissue stability. When the amount of Co added increase, the desired tensile strength cannot be obtain by precipitating residual austenite. Therefore, it is preferable that the upper limit of the amount of Co added is 1.0%.

Rhenium (Re) is an element improving the strength by solid solution strengthening and contributes for improving the toughness and corrosion-resistance. However, Re is extremely expensive. Therefore, in terms of cost, it is preferable that the upper limit is 1.0%.

Inevitable impurities in the present invention are components originally contained in the raw materials or incorporated during production and so on, and the term refers to components that are unintentionally added. Inevitable impurities include P, S, Sb, Sn, and As, and at least one of them may be contained in the precipitation hardening martensitic stainless steel of the present invention.

Since the reduction of P and S makes it possible to improve toughness without impairing tensile strength, it is preferable that they are minimized. In terms of improving the toughness, it is preferable that P: 0.5% or less and S: 0.5% or less. It is particularly preferable that P: 0.1% or less and S: 0.1% or less.

The reduction of As, Sb, and Sn makes it possible to improve toughness. Therefore, it is preferable that the above elements are minimized, and it is preferable that As: 0.1% or less, Sb: 0.1% or less, and Sn: 0.1% or less. It is particularly preferable that As: 0.05% or less, Sb: 0.05% or less, and Sn: 0.05% or less.

Even when the composition satisfies the above component range, in order for the tissue after an aging heat treatment to be a uniform tempered martensite tissue without a sub-zero treatment, it is necessary that the following parameters A and B are simultaneously within the specific range. Incidentally, the uniform tempered martensite tissue herein refers to a tissue in which δ-ferrite, residual austenite, and fresh martensite are each less than 10%.

$$(Cr+2.2Si+1.1Mo+0.6W+4.3Al+2.1Ti)-(Ni+31.2C+0.5Mn+27N+1.1Co) \quad A:$$

$$(12.5-4.0Cr-6.0Ni-3.0Mo+2.5Al-1.5W-3.5Mn-3.5Si-5.5Co-2.0Ti-221.5C-321.4N) \quad B:$$

Specific range: $4.0 \leq A \leq 10.0$ and $2.0 \leq B \leq 7.0$

A is a parameter relating to the stability of a martensite tissue. In order to obtain a uniform tempered martensite tissue, the parameter A is preferably 4.0 or more and 10 or less within the component range of the steel of the present invention. The precipitation of δ-ferrite and residual austenite causes the deterioration of characteristics such as tensile strength. Therefore, in terms of safety, their allowable precipitation amounts have been specified as 1.0% and 10% or less, respectively. When the parameter A is less than 4.0, the amount of residual austenite precipitated is 10% or more. In addition, the austenite stabilization tendency is strong, and, even when the below-mentioned parameter B is within the specific range, martensite transformation does not complete without a sub-zero treatment. Thus, even by an aging treatment at a temperature equal to or lower than the Ac1 temperature, austenite cannot be decomposed to 10% or less. In addition, when the parameter A is more than 10, the amount of δ-ferrite precipitated is 10% or more.

B is a parameter of the transformation temperature of a material of the present invention. The parameter B is preferably 2.0 or more within the component range of the steel of the present invention to achieve a martensite transformation finish-temperature of 20° C. or more, which is an index for obtaining a uniform tempered martensite tissue without a sub-zero treatment. Meanwhile, when the parameter B is more than 7.0, the Ac1 temperature is low. As a result, during an aging treatment at 500 to 600° C. for the steel of the present invention, a hard and brittle fresh martensite tissue is produced in an amount of 10% or more, resulting in toughness that is lower than desired.

Accordingly, when a component range is selected so that the range is satisfied with 4.0 or more and 10.0 or less of the parameter A and 2.0 or more and 7.0 or less of the parameter B, an alloy having high strength, high toughness, and high corrosion-resistance and also having a uniform tempered martensite tissue without a sub-zero treatment can be obtained.

Next, the heat treatment of the present invention will be described.

In the present invention, it is necessary to perform a solution treatment in which heating and maintenance at 900 to 1000° C., preferably at 925 to 975° C., are followed by rapid cooling. The solution treatment in the present invention refers to a heat treatment for both dissolving components relating to the formation of precipitates such as Al and Ti into the tissue and obtaining a martensite tissue at the same time. During this process, as mentioned above, δ-ferrite contained in the tissue is decomposed. After the solution treatment, it is necessary to perform an aging treatment of maintenance of heating at 400 to 600° C. and thereby gradual cooling. The aging treatment of the present invention refers to a heat treatment to obtain excellent strength by finely precipitating Ni—Al and Ni—Ti compounds and so on in the tissue performed after the solution treatment.

The application of the alloy of the present invention to a steam turbine long blade is described. The operations of shaping and curve elimination may be performed after the aging treatment. However, when these operations are performed immediately after the solution treatment where Ni—Al and Ni—Ti compounds and the like have not precipitated, the processability is excellent, and thus high working efficiency can be expected.

In a steam turbine long blade applied the alloy of the present invention, Stellite of a Co-based alloy may be joined to the front end portion of the blade by TIG welding. This is a measure to protect the steam turbine long blade from erosion damaging the blade by the high-speed collision of condensed steam.

Other techniques for the installation of Stellite include silver brazing, plasma transferred-arc and laser build-up welding. Other measures to protect the steam turbine long blade from erosion include modification of the surface with a titanium nitride coating, etc. It is also possible for achievement of erosion resistance by multi-repeating heat treatment of heating the surface of the front end portion of the blade to the Ac3 transformation temperature or higher and then cooling to room temperature by air cooling to a grain size of 6 or finer, followed by the aging treatment of the entire blade to increase only the surface hardness of the front end portion of the blade. Since the alloy of the present invention has a certain degree of erosion resistance, the above measure against erosion may be omitted under conditions of which erosion is not severe.

Hereinafter, the present invention will be described with reference to the drawings.

FIG. 1 shows a steam turbine long blade (10) applied the alloy of the present invention. The long blade comprises a blade profile portion (1) receiving steam, a blade root portion where the blade is implanted into a rotor (2), a stub (4) for integrating with an adjacent blade by screwing, and a continuous cover (5). The blade root portion of the steam turbine long blade is an axial entry type having an inverted Christmas-tree shape. The blade joins a Stellite plate as an example of an erosion shield (3). Other techniques for the installation of Stellite include silver brazing, plasma transferred-arc and laser build-up welding. It is also possible to modify the surface with a titanium nitride coating, etc. Since the alloy of the present invention has a certain degree of erosion resistance, the above measure against erosion may be omitted under conditions of which erosion is not severe.

Figure 2:
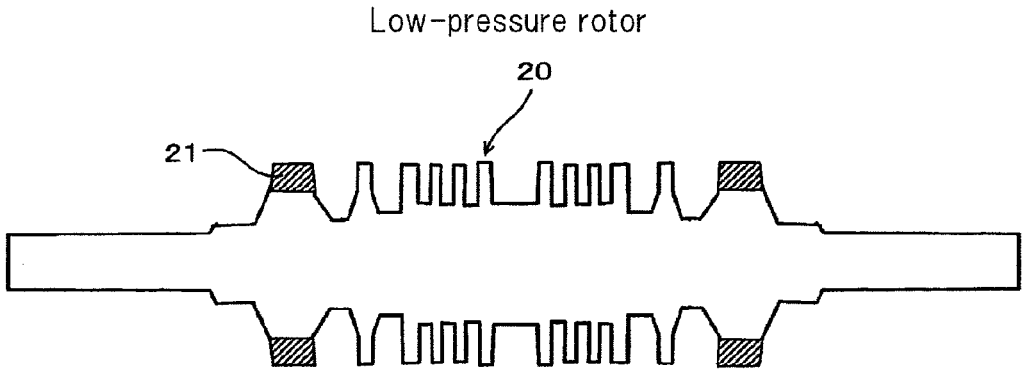

FIG. 2 shows a low-pressure stage rotor (20) applied the long blade of the present invention. The low-pressure stage rotor has a double-flow tissue, and long blades are symmetrically placed in a long-blade implantation portion (21) over several stages. The long blade mentioned above is placed in the final stage.

Figure 3:
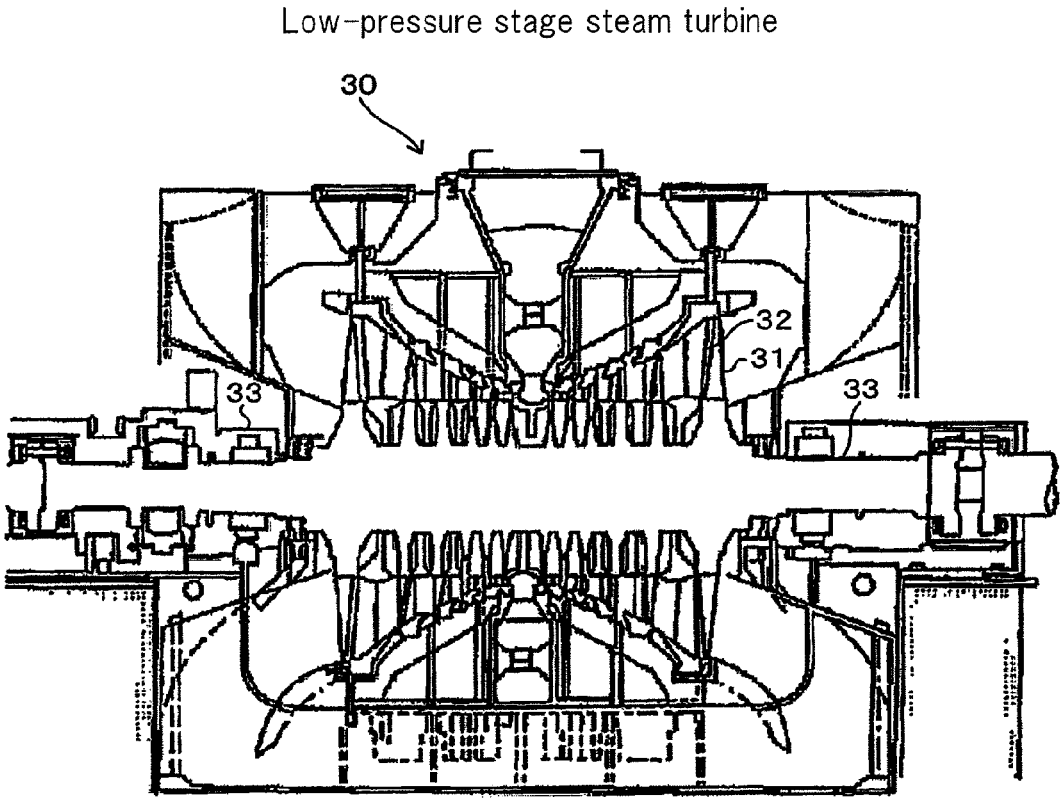

FIG. 3 shows a low-pressure stage steam turbine (30) applied the low-pressure stage rotor of the present invention. A steam turbine long blade (31) rotates by receiving steam guided by a nozzle (32). The rotor is supported by a bearing (33).

Figure 4:
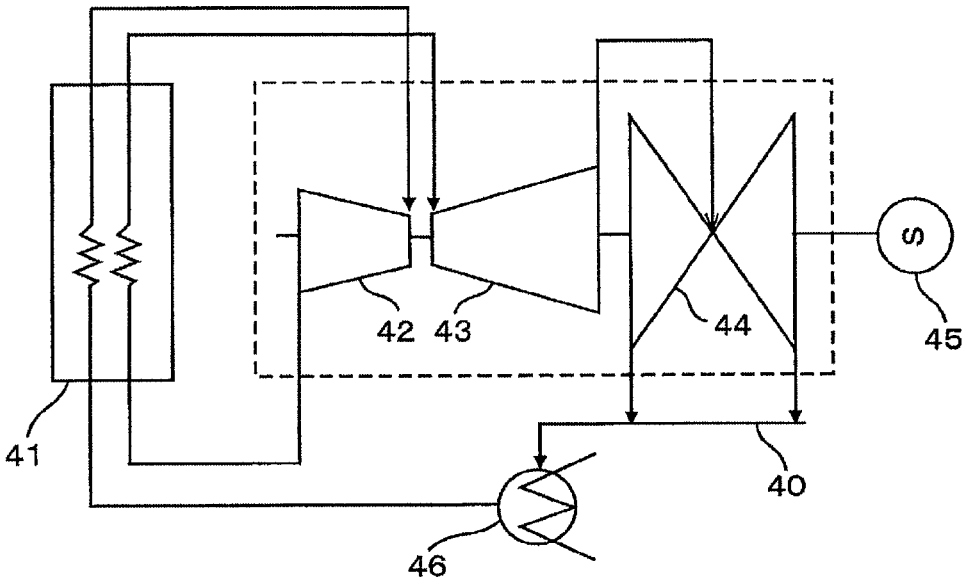

FIG. 4 shows a power plant (40) applied the low-pressure stage steam turbine of the present invention. High-temperature and high-pressure steam produced in a boiler (41) works in a high-pressure stage turbine (42) and is then reheated in the boiler. The reheated steam works in a medium-pressure stage turbine (43) and then works in a low-pressure stage turbine (44). The work occurred in a steam turbine is converted into electricity in a power generator (45). The steam coming out from the low-pressure stage turbine is guided to a condenser (46).

Hereinafter, examples will be described.

EXAMPLES

Example 1

Test samples were prepared to evaluate the relation between the chemical composition of a precipitation hardening martensitic stainless steel of the present invention and its tensile strength, 0.02% resistance, Charpy impact absorption energy, pitting potential, microtissue observation, and martensite transformation finish-temperature.

Table 1 shows the chemical composition of each test sample.

TABLE 1

| | | Component (wt %) | | | | | | | | | | | | | Parameter | Parameter | |
|---|---|---|---|---|---|---|---|---|---|---|---|---|---|---|---|---|---|
| Classification | No. | C | Cr | Ni | Si | Mn | Al | P | S | Mo | W | Ti | N | Co | A | B | (Al + Ti) |
| Alloy of the Invention | Alloy 1 | 0.01 | 12.05 | 11.06 | 0.002 | 0.05 | 1.28 | 0.002 | 0.002 | 1.41 | — | 0.65 | 0.002 | — | 9.0 | 5.1 | 1.93 |
| | Alloy 2 | 0.01 | 12.89 | 11.02 | 0.002 | 0.05 | 1.25 | 0.002 | 0.002 | 1.42 | — | 0.67 | 0.001 | — | 9.9 | 2.1 | 1.92 |
| | Alloy 3 | 0.01 | 10.44 | 12.62 | 0.002 | 0.05 | 1.26 | 0.002 | 0.002 | 1.47 | — | 0.68 | 0.001 | — | 5.9 | 2.2 | 1.94 |
| | Alloy 4 | 0.01 | 11.99 | 11.13 | 0.002 | 0.04 | 1.53 | 0.002 | 0.002 | 1.43 | — | 0.62 | 0.002 | — | 9.9 | 5.6 | 2.15 |

TABLE 1-continued

| Classification | No. | Component (wt %) | | | | | | | | | | | | | Parameter | Parameter | |
|---|---|---|---|---|---|---|---|---|---|---|---|---|---|---|---|---|---|
| | | C | Cr | Ni | Si | Mn | Al | P | S | Mo | W | Ti | N | Co | A | B | (Al + Ti) |
| | Alloy 5 | 0.01 | 11.99 | 11.09 | 0.002 | 0.05 | 0.73 | 0.002 | 0.002 | 1.46 | — | 1.48 | 0.002 | — | 8.4 | 1.9 | 2.21 |
| | Alloy 6 | 0.01 | 12.03 | 11.09 | 0.002 | 0.05 | 1.23 | 0.002 | 0.002 | 2.32 | — | 0.61 | 0.002 | — | 9.7 | 2.2 | 1.84 |
| | Alloy 7 | 0.01 | 12.01 | 11.05 | 0.002 | 0.05 | 1.23 | 0.002 | 0.002 | 0.78 | 0.73 | 0.63 | 0.001 | — | 8.5 | 6.3 | 1.86 |
| | Alloy 8 | 0.01 | 11.98 | 10.01 | 0.002 | 0.05 | 1.23 | 0.002 | 0.002 | 1.35 | — | 0.62 | 0.001 | 1.05 | 8.5 | 6.3 | 1.85 |
| Comparative | Alloy 9 | 0.01 | 13.09 | 10.08 | 0.002 | 0.05 | 1.28 | 0.002 | 0.002 | 1.41 | — | 0.65 | 0.002 | — | 11.0 | 6.8 | 1.93 |
| Alloy | Alloy 10 | 0.01 | 9.06 | 13.06 | 0.002 | 0.04 | 1.28 | 0.002 | 0.002 | 1.44 | — | 0.61 | 0.001 | — | 3.9 | 5.3 | 1.89 |
| | Alloy 11 | 0.01 | 12.28 | 11.26 | 0.002 | 0.06 | 1.25 | 0.002 | 0.002 | 1.48 | — | 0.69 | 0.001 | — | 8.7 | 1.6 | 1.94 |
| | Alloy 12 | 0.01 | 11.05 | 11.03 | 0.002 | 0.06 | 1.26 | 0.002 | 0.002 | 1.35 | — | 0.63 | 0.001 | — | 7.5 | 8.3 | 1.39 |
| | Alloy 13 | 0.01 | 10.51 | 11.62 | 0.002 | 0.05 | 1.52 | 0.002 | 0.002 | 1.42 | — | 1.56 | 0.001 | — | 9.9 | 6.9 | 3.08 |
| | Alloy 14 | 0.01 | 12.15 | 10.52 | 0.002 | 0.05 | 0.26 | 0.002 | 0.002 | 1.43 | — | 0.31 | 0.001 | — | 4.6 | 6.3 | 0.57 |

First, raw materials were melted using a high-frequency vacuum melting furnace ($5.0\times10^{-3}$ Pa or less, 1600° C. or higher) to obtain the composition shown in Table 1. The obtained ingot was hot-forged using a press forge machine and a hammer forge machine and formed into a square bar having a width×thickness×length of 100 mm×30 mm×1000 m. Next, the square bar was cut and processed to a width×thickness×length of 50 mm×30 mm×120 mm, thereby giving stainless steel starting materials.

Next, the stainless steel starting materials were subjected to various heat treatments using a box electric furnace. Alloys 1 to 14 were maintained at 950° C. for 1 hour as a solution heat treatment, followed by rapid water cooling of immersing in room-temperature water. Subsequently, the alloys were maintained at 500° C. for 2 hours as an aging heat treatment, followed by air cooling of removing it into room-temperature air.

The samples obtained above were evaluated tests for tensile strength, Charpy impact absorption energy, pitting potential, microtissue observation, and martensite transformation finish-temperature, respectively. The following summarizes each evaluation test.

For the measurement of tensile strength and 0.02% resistance, a test piece of which distance between evaluation points: 30 mm, outer diameter: 6 mm was prepared from each of the samples obtained above and subjected to a tensile test at room temperature in accordance with JIS Z 2241. The criteria of tensile strength and 0.02% resistance were as follows. A tensile strength and a 0.02% resistance of 120 kgf/cm$^2$ or more and 90 kgf/cm$^2$ or more, respectively, were rated as "acceptable" and of less than these values were rated as "unacceptable".

For the measurement of Charpy impact absorption energy, a test piece having a 2-mm V-notch was prepared from each of the samples obtained above and subjected to a Charpy impact test at room temperature in accordance with JIS Z 2242. The criteria of Charpy impact absorption energy were as follows. A Charpy impact absorption energy of 20 J or more was rated as "acceptable" and of less than this value was rated as "unacceptable".

For the evaluation of pitting potential, a plate-like test piece having 15 mm in length, 15 mm in width, and 3 mm in thickness was prepared from each of the samples obtained above. The evaluation was performed under the following conditions: test solution: 3.0% NaCl solution, temperature of the solution: 30° C., sweep rate: 20 mV/min. The criteria of pitting potential were as follows. A pitting potential of 150 mV or more was rated as "acceptable" and of less than this value was rated as "unacceptable."

The criteria of microtissue were as follows. Those having a uniform tempered martensite tissue in which the amounts of δ-ferrite, residual austenite, and fresh martensite precipitated were 1.0%, 10%, and 10% or less, respectively, were rated as "acceptable". Others were rates as "unacceptable". The amount of δ-ferrite precipitated was measured in accordance with the point counting method described in JIS G 0555. The amount of residual austenite precipitated was measured by X-ray diffraction. In addition, the amount of fresh martensite precipitated was measured by transmission electron microscope observation.

Martensite transformation finish-temperature was evaluated by thermodilatometry. A cylindrical test piece of ϕ3.0×L 10 was prepared and subjected to a temperature cycle of heating from 0° C., maintaining at 950° C. for 30 minutes, and then cooling to −100° C. The heating and cooling rates were 100° C./min, and the evaluation was performed in an argon atmosphere. The acceptance criterion of martensite transformation finish-temperature was 20° C. or higher. Table 2 shows the test results of each material.

TABLE 2

| | No. | Tensile Strength | 0.02% Resistance | Impact Absorption Energy | Pitting Potential | Micro-tissue | Martensite Transformation Finish Temperature |
|---|---|---|---|---|---|---|---|
| Alloy of | Alloy 1 | ○ | ○ | ○ | ○ | ○ | ○ |
| the Inventio | Alloy 2 | ○ | ○ | ○ | ○ | ○ | ○ |
| | Alloy 3 | ○ | ○ | ○ | ○ | ○ | ○ |
| | Alloy 4 | ○ | ○ | ○ | ○ | ○ | ○ |
| | Alloy 5 | ○ | ○ | ○ | ○ | ○ | ○ |
| | Alloy 6 | ○ | ○ | ○ | ○ | ○ | ○ |
| | Alloy 7 | ○ | ○ | ○ | ○ | ○ | ○ |
| | Alloy 8 | ○ | ○ | ○ | ○ | ○ | ○ |

TABLE 2-continued

| | No. | Tensile Strength | 0.02% Resistance | Impact Absorption Energy | Pitting Potential | Micro-tissue | Martensite Transformation Finish Temperature |
|---|---|---|---|---|---|---|---|
| Comparative Alloy | Alloy 9 | x | x | x | x | x | x |
| | Alloy 10 | x | x | ○ | x | x | x |
| | Alloy 11 | x | x | ○ | x | x | x |
| | Alloy 12 | ○ | ○ | x | ○ | x | ○ |
| | Alloy 13 | ○ | ○ | x | ○ | ○ | ○ |
| | Alloy 14 | x | x | ○ | ○ | ○ | ○ |

In Alloys 1 to 8 of the present invention, the components and parameters were all within the specific ranges, and the mechanical characteristics including tensile strength, 0.02% resistance, and Charpy impact absorption energy were also acceptable. Further, the results of pitting potential were also excellent. In addition, no δ-ferrite phase, residual austenite phase, or fresh martensite was seen in the metal tissue, and they were thus confirmed to have a uniform tempered martensite tissue. The martensite transformation finish-temperature was also 20° C. or higher and acceptable.

In Alloy 9, although the components were all within the specific range, the parameter A was more than 10, and the precipitation of δ-ferrite in an amount of 1.0% or more was observed. It was thus unacceptable. Other characteristics were also unacceptable.

In Alloy 10, although the components were all within the specific range, the parameter A was less than 4, and the precipitation of residual austenite in an amount of 10% or more was observed in the tissue. It was thus unacceptable. Characteristics other than impact absorption energy were also unacceptable.

In Alloy 11, although the components were all within the specific range, the parameter B was 2.0 or less, the martensite transformation finish-temperature was 20° C. or lower, and the precipitation of residual austenite in an amount of 10% or more was observed in the tissue. It was thus unacceptable. Characteristics other than impact absorption energy were also unacceptable.

In Alloy 12, although the components were all within the specific range, the parameter B was 7.0 or more, and the amount of fresh martensite precipitated was 10% or more. It was thus unacceptable. Impact absorption energy was also unacceptable.

In Alloy 13, although the components and parameters were all within the specific ranges, the total amount of Al and Ti was 2.25% or more by mass, leading to excessive precipitation, and impact absorption energy was unacceptable.

In Alloy 14, although the components and parameters were all within the specific ranges, the total amount of Al and Ti was 0.5% or less by mass, leading to insufficient precipitation, and impact absorption energy was unacceptable.

Figure 5:
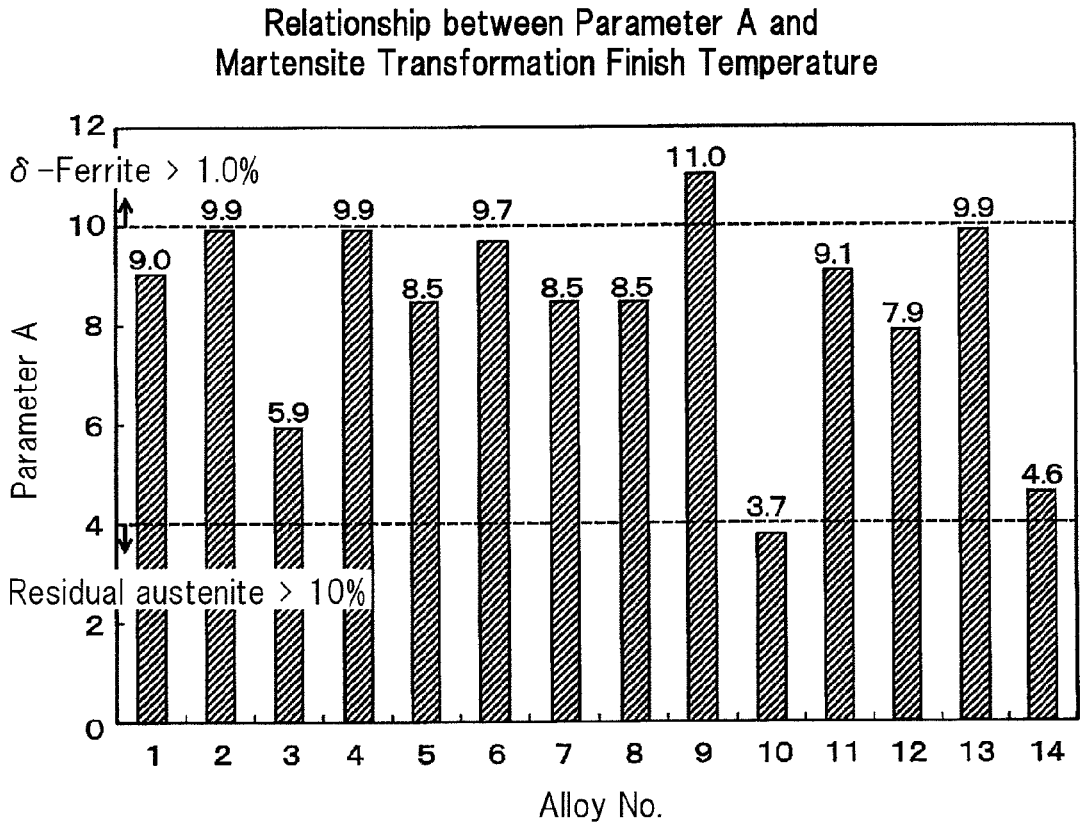
FIG. 5 shows the relation between the parameter A with the amounts of δ-ferrite and residual austenite precipitated in alloys of the present invention.

FIG. 5 shows the relation of the parameter A with amounts of δ-ferrite and residual austenite precipitated of alloys shown in Table 1. It is necessary that the parameter A is 4 or more and 10 or less to achieve the object of the present invention that the amount of δ-ferrite precipitated is 1.0% or less and the amount of residual austenite precipitated is 10% or less.

Figure 6:
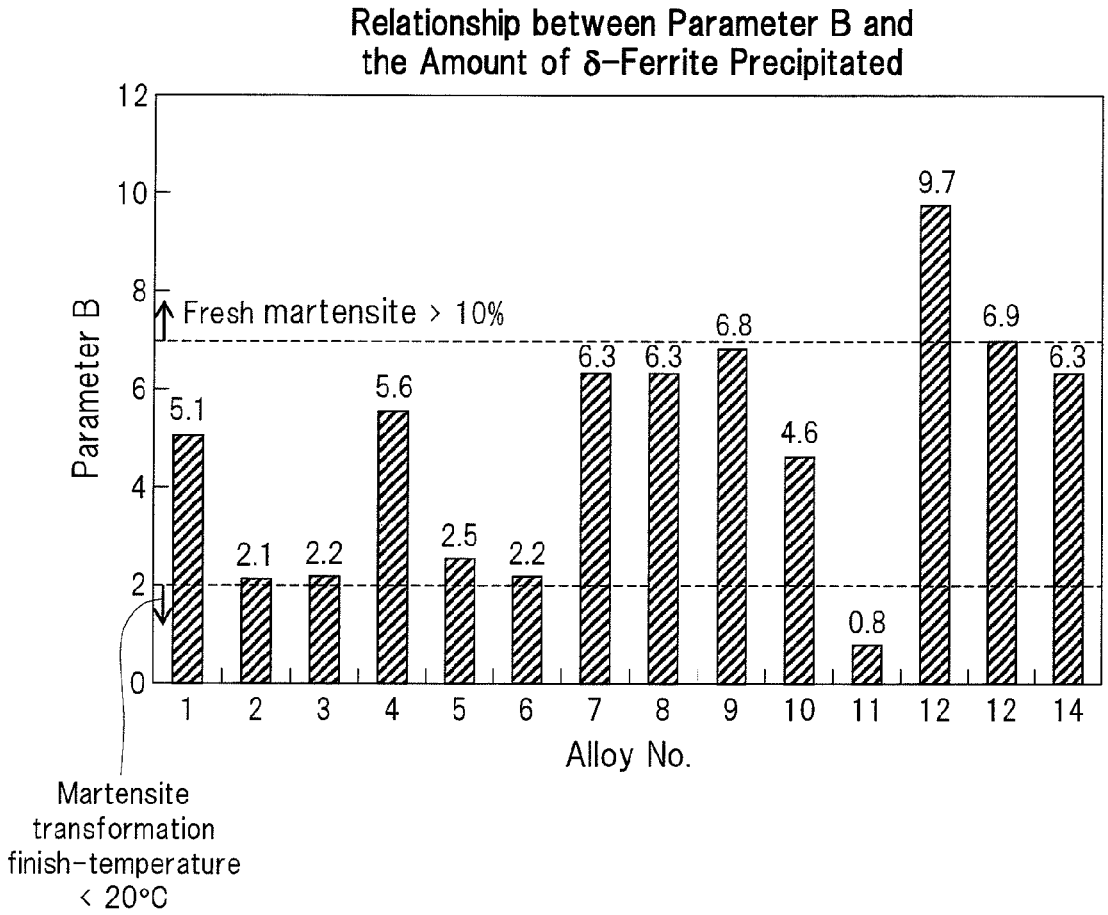
FIG. 6 shows the relation between the parameter B with the amount of fresh martensite precipitated and the martensite transformation finish-temperature in alloys of the present invention.

FIG. 6 shows the relation between the parameter B and martensite transformation finish-temperature. It is necessary that the parameter B is 2.0 or more and 7.0 or less to achieve the object of the present invention that the martensite transformation finish-temperature is 20° C. or higher and the amount of fresh martensite precipitated is 10% or less.

Figure 7:
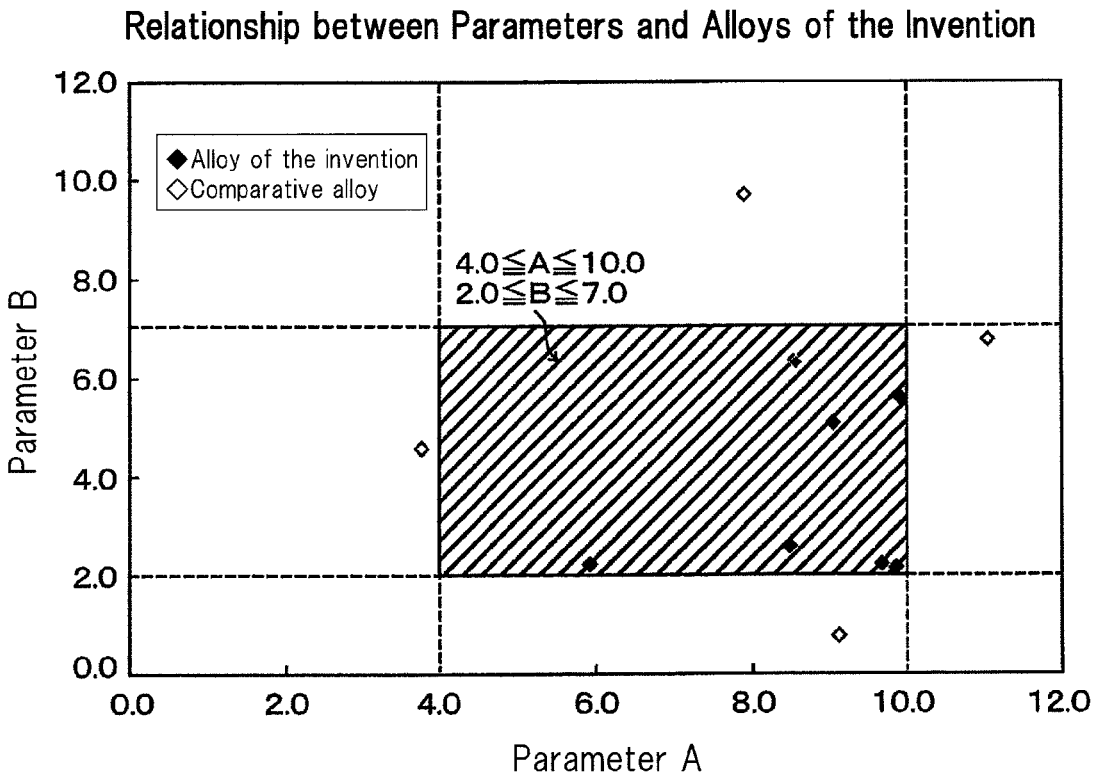
FIG. 7 shows the relation between the parameters and alloys of the invention.
Figure 8:
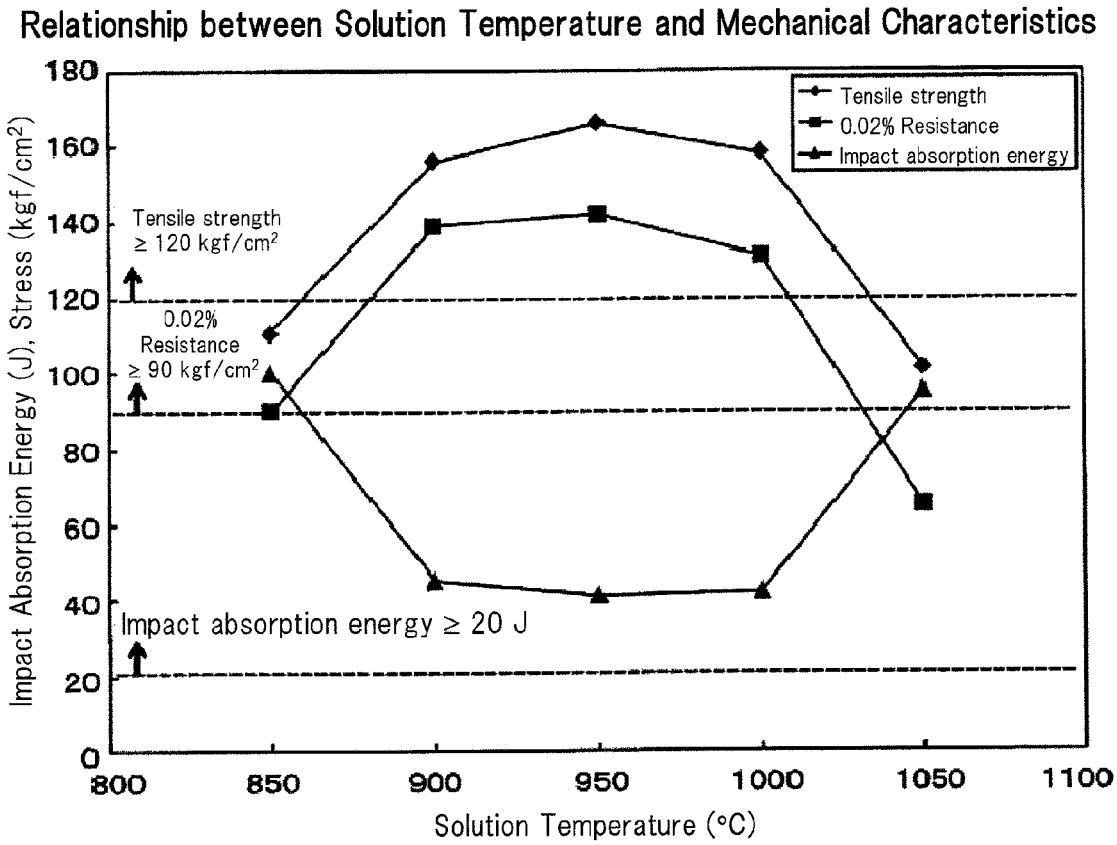
FIG. 8 shows the relation between solution temperature and the mechanical characteristics of an alloy of the present invention.
Figure 9:
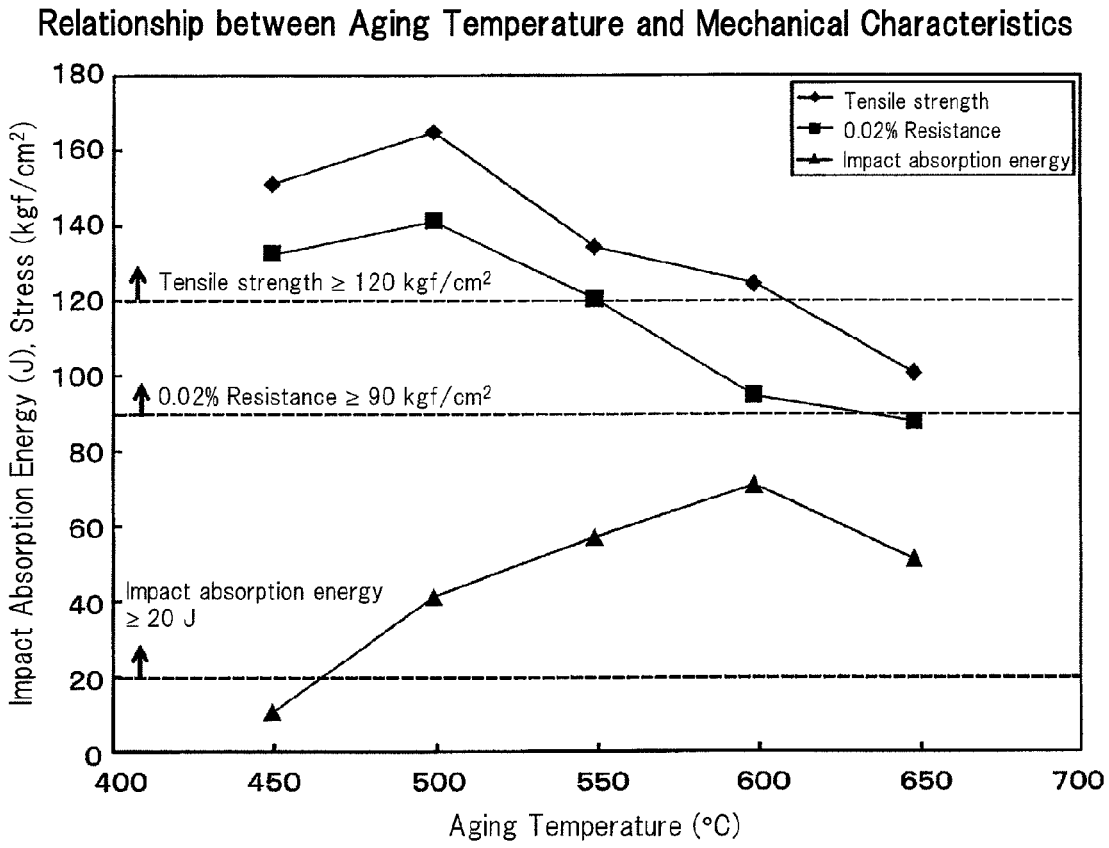
FIG. 9 shows the relation between aging temperature and the mechanical characteristics of an alloy of the present invention.

FIG. 7 shows the relation between each of the alloys shown in Table 1 and the parameters A and B. The shaded portion shows a preferable range of both A and B. Some of comparative alloys and alloys of known examples are within the shaded portion. However, since the design concepts of alloy are different, the range of the amount of each element added is different from the scope of the present invention.

Example 2

Consideration of Heat Treatment Conditions

It is examined that the heat treatment conditions for a solution heat treatment and an aging heat treatment using Alloy 1 of the present invention. FIG. 7 shows the results of the examination of the relation between solution temperature and mechanical characteristics. When the aging condition was carried out by maintenance at 500° C. for 2 hours and then air cooling, the solution temperature being higher than 1000° C. lead to excessive δ-ferrite, an increase in grain size, etc. As a result, tensile strength, 0.02% resistance, Charpy impact absorption energy, and microtissue were unacceptable. Since the solution temperature being lower than 900° C. lead to an increase in undissolved precipitates, mechanical strength was also unacceptable. Accordingly, it was determined that a preferred solution temperature is 900 to 1000° C. A temperature of 925 to 975° C. is more preferable.

FIG. 7 shows the results of the examination of the relation between aging temperature and mechanical characteristics. When the aging temperature was 450° C., impact absorption energy was unacceptable. When the aging temperature was 650° C., tensile strength and 0.2% resistance were unacceptable. It was therefore determined that a preferred aging temperature is 500 to 600° C. In terms of the balance between tensile strength and Charpy impact absorption energy, it is more preferably 525 to 575° C., and still more preferably 540 to 560° C.

Example 3

The following describes a steam turbine long blade using an alloy of the present invention. In this embodiment, using Alloy 1 shown in Table 1 of a material of the present invention, an axial-entry-type steam turbine long blade having a blade length of 48 inch was produced. As a method for producing the long blade, first, vacuum carbon deoxidation was performed in a high vacuum of $5.0\times10^{-3}$ Pa or less to deoxidize molten steel by the chemical reaction $C+O\rightarrow CO$. Subsequently, the steel was formed into an electrode bar by cogging. Electro-slag remelting was thus performed to give a high-grade steel ingot by self-dissolving by Joule heat produced upon the application of current when the electrode bar was immersed in molten slag and then coagulating in a water-cooled die. Next, after hot-forged of the steel ingot, press-forged using a 48-inch blade die. After that, as a solution treatment, the resulting product was heated and maintained at 980° C. for 2.0 hours, followed by forced cooling of rapid cooling using a fun. Then, the product was formed into a predetermined shape through a cutting step and then, as an aging treatment, heated and maintained at 550° C. for 4.0 hours, followed by air cooling. As the final finishing, the curve was eliminated and the surface was polished, thereby giving a 48-inch long blade.

Test pieces were collected from the front end, center, and root portions of the steam turbine long blade obtained by the above steps, respectively, and subjected to the evaluation test in the same manner as in Example 1. The direction of the obtained test pieces is the direction of the length of the blade.

The microtissue of each portion was a uniform martensite tissue. No residual austenite was observed, and also δ-ferrite was 1.0% or less. In addition, regardless of the position where the test piece was obtained, the desired tensile strength, 0.02% resistance, Charpy impact value, pitting potential, and martensite transformation finish-temperature were all achieved.

The precipitation hardening martensitic stainless steel of the present invention has excellent martensite tissue stability, high strength, high toughness, and high corrosion-resistance, and thus can be applied to a steam turbine long blade. It can also be applied to a blade for a gas turbine compressor, and so on.

What is claimed is:

1. A precipitation hardening martensitic stainless steel comprising, by mass, 0.1% or less of C; 0.1% or less of N; 9.0% or more and 14.0% or less of Cr; 9.0% or more and 14.0% or less of Ni; 0.5% or more and 1.47% or less total of Mo with optional W; 0.5% or less of Si; 1.0% or less of Mn; 0.25% or more and 1.75% or less of Ti; 0.25% or more and 1.75% or less of Al; 1.0% or less of Co and the rest is Fe and inevitable impurities, and a parameter A related to martensite transformation finish-temperature and a parameter B related to martensitic tissue stability satisfying the following specific range:

$$(Cr+2.2Si+1.1Mo+0.6W+4.3Al+2.1Ti)-(Ni+31.2C+0.5Mn+27N+1.1Co) \quad A:$$

$$(125-4.0Cr-6.0Ni-3.0Mo+2.5Al-1.5W-3.5Mn-3.5Si-5.5Co-2.0Ti-221.5C-321.4N), \text{ and,} \quad B:$$

Specific range: $4.0 \leq A \leq 10.0$ and $2.0 \leq B \leq 7.0$.

2. The precipitation hardening martensitic stainless steel according to claim 1, wherein the total amount of Al and Ti is 0.75% or more and 2.25% or less by mass.

3. The precipitation hardening martensitic stainless steel according to claim 1, further comprising at least one member selected from Nb, V, and Ta wherein the total amount thereof is 0.5% or less by mass.

4. The precipitation hardening martensitic stainless steel according to claim 1, further comprising, by mass, Re: 1.0% or less.

5. The precipitation hardening martensitic stainless steel according to claim 1, wherein the inevitable impurities are at least one member selected from S, P, Sb, Sn, and As, the amounts thereof being, by mass, S: 0.5% or less, P: 0.5% or less, Sb: 0.1% or less, Sn: 0.1% or less, and As: 0.1% or less.

6. The precipitation hardening martensitic stainless steel according to claim 1, wherein a temperature range of a solution treatment is 900 to 1000° C. and a temperature range of an aging treatment is 500 to 600° C.

7. A steam turbine long blade using the precipitation hardening martensitic stainless steel of claim 1.

8. The steam turbine long blade according to claim 7, wherein a Stellite plate made of a Co-based alloy is joined to a front end portion of the blade.

9. A turbine rotor comprising the steam turbine long blade of claim 7.

10. A steam turbine comprising the turbine rotor of claim 9.

11. A power plant comprising the steam turbine of claim 10.

* * * * *